United States Patent [19]

Weiss

[11] Patent Number: 5,002,513

[45] Date of Patent: Mar. 26, 1991

[54] MODEL BUILDING KIT FOR RAILROADS

[76] Inventor: Richard I. Weiss, 18271 Beverly Rd., Birmingham, Mich. 48009

[21] Appl. No.: 355,175

[22] Filed: May 22, 1989

[51] Int. Cl.[5] ..... A63H 33/04

[52] U.S. Cl. ..... 446/87; 446/110

[58] Field of Search ..... 446/110, 105, 87, 108, 446/111, 118, 476; 434/72

[56] References Cited

U.S. PATENT DOCUMENTS

| | | | |
|---|---|---|---|
| 311,793 | 2/1885 | Stranders | 446/105 |
| 1,523,347 | 1/1925 | Murmann | 446/110 X |
| 2,422,217 | 6/1947 | Barnes | 446/110 x |
| 3,069,806 | 12/1962 | Wright et al. | 446/110 |
| 4,219,960 | 9/1980 | Walmer et al. | 446/110 |

OTHER PUBLICATIONS

"Girder and Panel", Kenner Products Co., Playthings magazine, p. 56, Aug. 1960.

Burroughs, Albin; The Modular Method of Kit-Conversion; Model Railroading, vol. 13, No. 1, pp. 67-72, Fall 1982.

Burroughs, Albin; Kit-Conversion: Kibri Modular--Wall Brick Industry; Model Railroading, pp. 52-57, Jul./Aug., 1986.

*Primary Examiner*—Mickey Yu

*Attorney, Agent, or Firm*—Harness, Dickey & Pierce

[57] ABSTRACT

A model building kit deploying interchangeable wall panels in order to create a variety of building designs. The model building kit includes wall panels made up of interchangeable sub-units which further allows the builder to conform each individual panel to his needs. The wall panels interconnect with one another and are vertically supported by columns. The columns support a roof panel which may be also used in the interior of the building as floors. The style of architecture of the model kit is that of an industrial building such as a factory or warehouse.

19 Claims, 7 Drawing Sheets

MODEL BUILDING KIT FOR RAILROADS

BACKGROUND AND SUMMARY OF INVENTION

This invention relates generally to a model building kit and more particularly concerns a building kit for a model railroad with interchangeable modular units which provide the builder with a means of tailoring the building to the builder's specifications for a more realistic appearance.

Model railroading has become increasely popular in recent years. The hobby has expanded well beyond the traditional children's toy, developing to a level of expertise where many adults are expending much time and money in building accurate reproductions of the trains and their surroundings. Many of the landscapes used by the builders reflect the buildings of the late nineteenth century through the early to mid-twentieth century when the railroads were at their peak of popularity. Since trains were often used in conjunction with heavy industry, it is common for industrial sites, such as factories and warehouses, to be included in the model train's landscape.

In order for the hobbyist to build realistic landscapes, he must construct buildings accurately portraying the architecture of the time period. To model train enthusiasts, one important factor which distinguishes the model train set as a realistic reproduction from a prefabricated toy is the amount of detail in the buildings and authenticity of the architecture. In the past, to achieve the desired detail, many hobbyists would erect model buildings by cutting and gluing raw materials together. The assembly of a building from raw materials, such as balsa wood, allows the hobbyist to create any style, shape and size building, and further provides the hobbyist with as much detail and creativity as his ability will permit. The assembly of such a building is very time consuming, however, especially when building a large warehouse of factory, and requires a high level of skill to construct with the required detail.

Another option open to the hobbyist is to buy a prefabricated model kit, which are easy to assemble and do not require the high level of skill or the amount of time required when building from raw materials. Model kits are designed to be erected as one specific building, however, which requires the builder to tailor the train layout around the building. Further, the kits do not allow the builder the needed creativity when designing authentically appearing landscapes. One of the easiest ways to make a model railroad look inaccurate is to use a building kit just as it is shown on the box, particularly if the model is made of injection molded plastic. Any experienced modeler can spot a mass produced kit at a glance. Hence, the time saved by using a kit is at the sacrifice of both realism and credibility. To avoid this pitfall, many hobbyists rely on a practice known as "kit bashing", where the hobbyist will purchase one or more hobby sets and modify the structure to meet his needs. While "kit bashing" provides the hobbyist with a wider range of creativity, it also increases the difficulty of assembling the desired building.

Therefore, there is a real need in model railroading for a model building kit that provides the builder with the realism and flexibility of building from raw materials and the convenience of a prefabricated kit.

In accordance with the present invention, as depicted in the drawings and described in more detail below, a model building kit is provided comprising interchangeable wall panels, which when assembled, form an accurate scale replica of an industrial building. Because the wall panels are interchangeable, a wide variety of building shapes and sizes may be erected. The kits, in one embodiment, will include enough of the wall panels to create either a complete building or a false facade. Since many builders have a limited area in which to construct the landscape, they must rely on the false facade. The architecture of the model building reflects a popular style of architecture used in the construction of factories and warehouses during the early to mid-twentieth century. The kit, in one embodiment, is built to 1:87 scale, otherwise known as H.O. scale in model railroading.

The wall panels are comprised of interchangeable sub-units. The sub-units are, in one embodiment, manufactured in injection molded plastic and colored during the manufacturing process so the building does not require painting. The interchangeable sub-units comprise windows, spandrels, sills, doors and foundations which allow the builder to design each wall to his individual needs. The claimed invention, in one embodiment, has slightly taller first floor panels to incorporate the building's foundation for proper authenticity. In this embodiment, the first floor panels are not interchangeable with the upper floor panels, but this is not of concern since a typical kit will include enough panels so there is no need to use the first floor panels on the upper floors.

The wall panels interconnect so when stacked upon one another, no seam is visible from the exterior of the building. The kit may further provide wall panels to construct a penthouse which is placed on top of the model building.

The wall panels are vertically connected by columns which are also interchangeable and comprised of three basic forms: straight wall columns, outside corner columns and inside corner columns, with the columns corresponding to the first floor panels being slightly longer to incorporate the foundation. The columns and the wall panels support a roof panel. The roof panel has a grid pattern notched into one side with the distance between the grids equal to the length of a wall panel. The roof may be cut along the grid pattern to conform to any size or shape building desired. The roof panel further may be used in the interior of the building as a floor so that the builder may add detail to the interior of the building.

It is, therefore, an object of the present invention to provide the model builder with a relatively simple to assemble, authentic model building kit which has enough detail to satisfy the needs of a model train enthusiast as to authenticity.

It is another object of the present invention to provide a model building kit which allows the builder to tailor the building's size and shape to meet his individual needs.

Further, it is an object of the present invention to provide the builder of the model kit an accurate reproduction of an early twentieth century factory or warehouse that does not require painting after assembly.

BRIEF DESCRIPTION OF THE DRAWINGS

Other objects and advantages of the invention will become apparent upon reading the following detailed description and upon reference to the drawings, in which.

While the invention will be described in connection with the preferred embodiment, it will be understood that it is not intended to limit the invention to that embodiment. To the contrary, it is intended to cover all alternatives, modifications and equivalents as may be included within the spirit and scope of the invention as defined by the appended claims.

DETAILED DESCRIPTION OF THE PREFERRED EMBODIMENT

Figure 1:
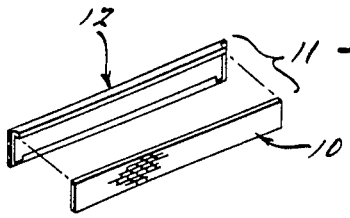
FIG. 1 is a perspective view and assembly of the brick facing attached to the sill wall.

Turning now to the drawings, FIG. 1 shows the assembly of the brick facing 10 to the sill panel 12 to form the sill wall 11 which, in a typical kit, thirty assemblies are required. The model kit is assembled by using any bonding agent, such as glue or epoxy, that will hold the units together. The brick facing 10 is colored and textured to resemble the brick used in an early twentieth century factory, and the sill panel 12 is colored to resemble concrete. The sill wall 11 is one of the basic pieces of the invention which gives the claimed invention its interchangeablity and authentic appearance. The kit, in the preferred embodiment, is designed to the H.O. scale used in model railroading, or 1:87, but can just as easily be designed to any necessary scale.

Figure 2:
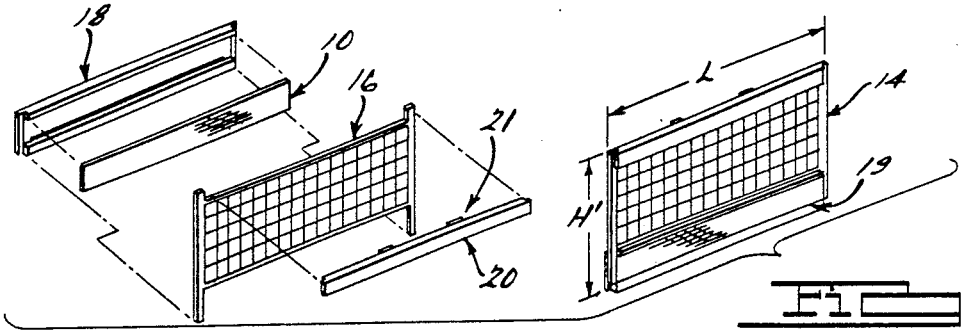
FIG. 2 is a perspective view and assembly of a window wall panel to be used on the first floor of the building.
Figure 3:
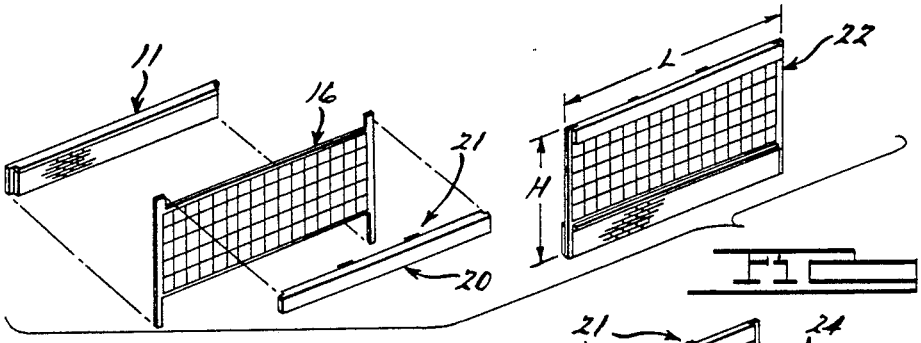
FIG. 3 is a perspective view and assembly of a window wall panel for the upper stories of the building.

FIG. 2 depicts the assembly of a first floor wall panel 14 which is comprised of the window frame 16, brick facing 10, first floor sill panel 18 with foundation 19 and spandrel beam 20. The brick facing 10 is secured to the first floor sill panel 18 which is then attached to the lower portion of the window frame 16. The spandrel beam 20, which corresponds to the location of the upper floors of the building and the roof panel 88, is added to the upper portion of the window frame 16 to form the first floor wall panel 14. The beam 20 further has tabs 21 which support the roof panel 88. Because of the foundation 19, this panel 14 is to be used on the first floor only, and is slightly taller than the wall panels to be used on the upper floors. In a typical kit, eight such assemblies are required. FIG. 3 depicts the assembly of a window panel 22 which utilizes the same window frame 16 as used in FIG. 2, but is to be used on the upper floors. The assembly of the sill wall 11, from FIG. 1, is attached to the lower portion of the window frame 16 and the spandrel beam 20 is attached to the upper portion of the window frame 16. Fifteen such assemblies are required. To conform with the H.O. scale, the wall panels are 67.5 millimeters in length (L), 41.4 millimeters in height (H) on the upper floors and 43.9 millimeters in height (H') for the first floor.

Figure 4:
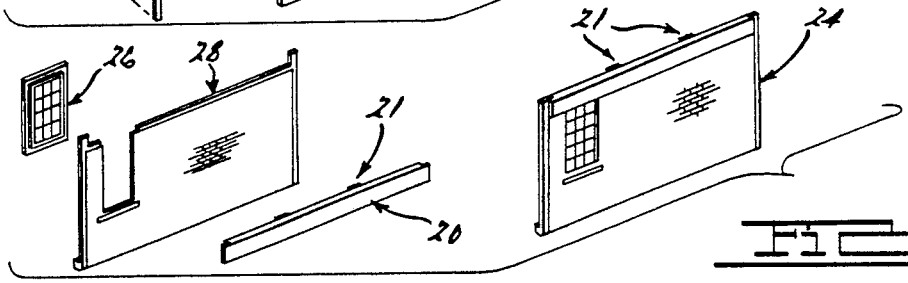
FIG. 4 is a perspective view and assembly of the wall panel corresponding to the elevator shaft.
Figure 5:
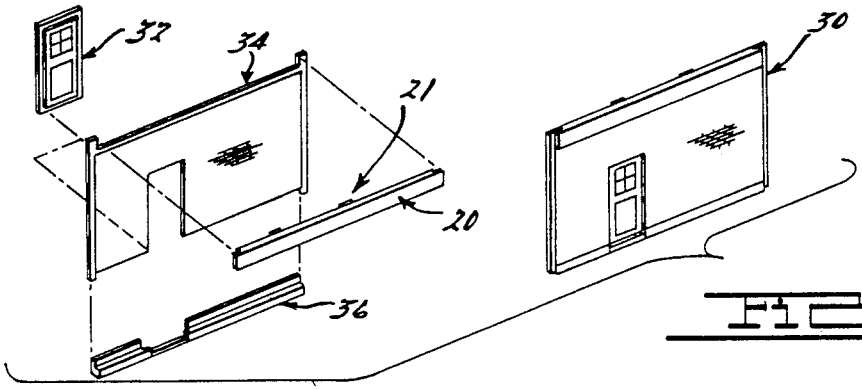
FIG. 5 is a perspective view and assembly of a wall panel containing one door.

FIGS. 4 and 5 depict the assembly of the wall panels 24 and 30 which represents the location of the elevator shaft within the building. The window 26 and spandrel beam 20 are attached to the corresponding openings in the brick wall sill 28 to form the wall panel 24. The wall panel 30 is assembled by attaching the door 32, foundation 36 and spandrel beam 20 to the brick wall sill 34. One assembly of wall panel 30 and three asemblies of wall panel 24 are required.

Figure 6:
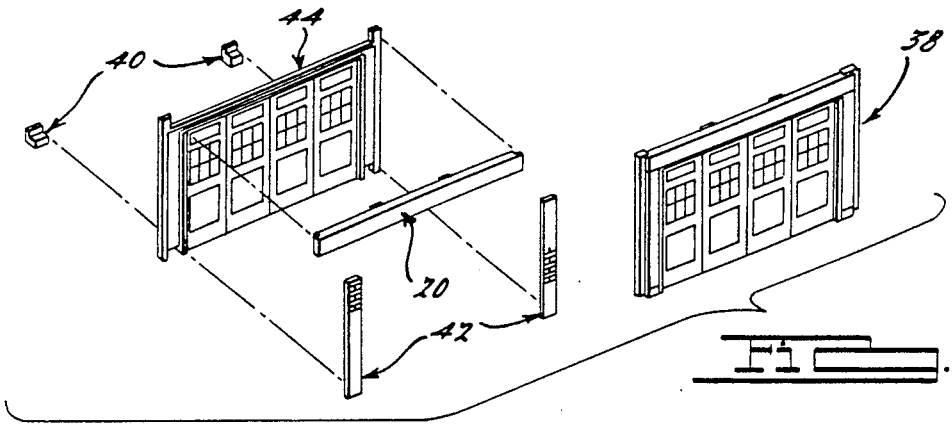
FIG. 6 is a perspective view and assembly of a wall panel containing delivery doors.
Figure 7:
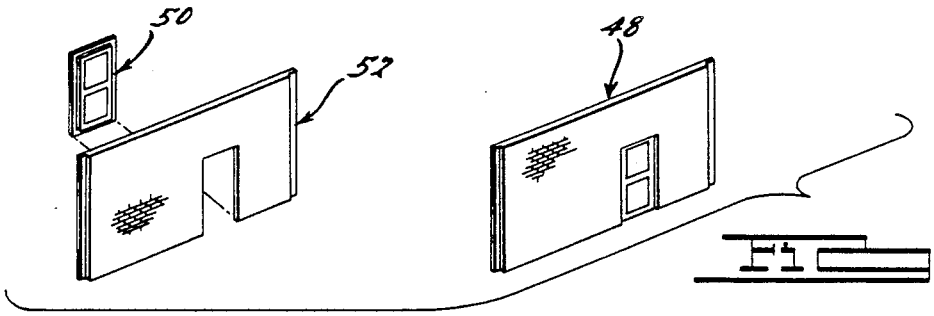
FIG. 7 is a perspective view and assembly of a wall panel containing a door corresponding to the penthouse.

The wall panel 38, as depicted in FIG. 6, represents the main delivery doors to the factory. The panel 38 is assembled by attaching the foundations 40, brick facings 42 and spandrel beam 20 to the delivery door panel 44. Note that there is no foundation under the delivery doors so that, in the original building, heavy equipment may enter the factory through the doors. In a typical kit, two such assemblies are required. FIG. 7 depicts the assembly of the wall panel 48 which contains the door leading from the roof into the penthouse 74 containing the elevator equipment. The panel 48 is the only wall panel with a door and without a foundation, since the panel is only to be mounted on the roof and is assembled by attaching door 50 to wall unit 52. One such assembly is required.

Figure 8:
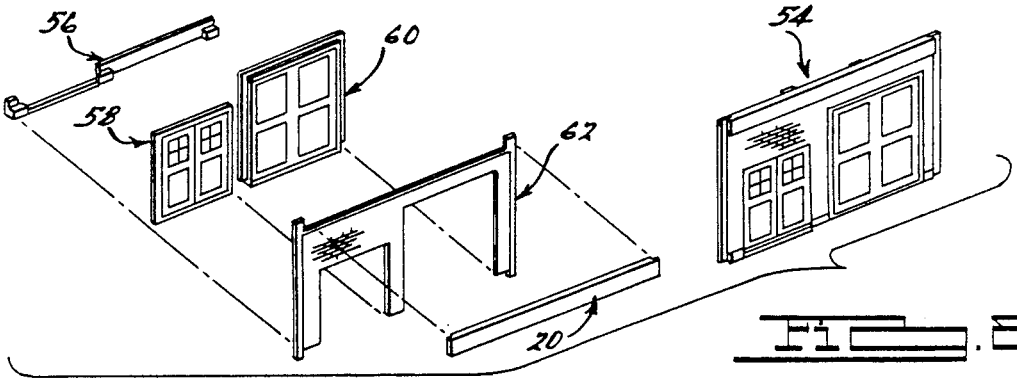
FIG. 8 is a perspective view and assembly of a wall panel containing delivery doors.
Figure 9:
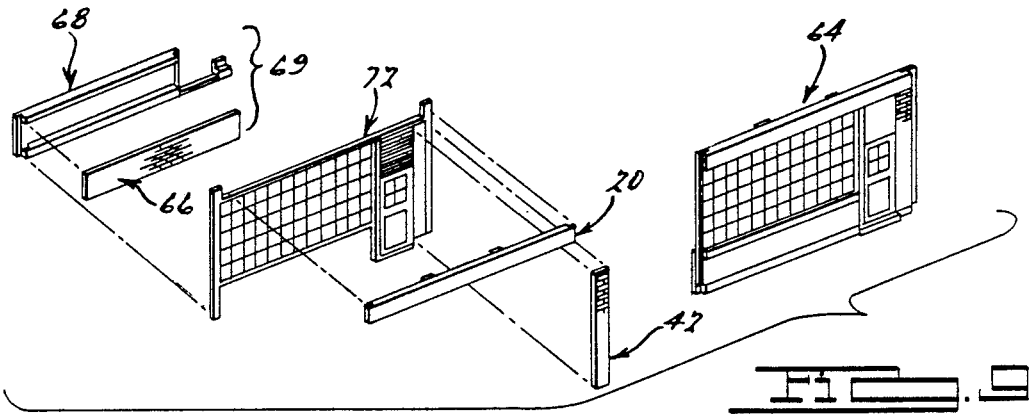
FIG. 9 is a perspective view and assembly of a wall panel containing windows and a door.

FIG. 8 depicts the assembly of the wall panel 54 which corresponds to a combination delivery door and employee entrance door wall panel. Panel 54 is assembled by attaching foundation 56, doors 58, 60, and spandrel beam 20 to wall unit 62. One such assembly is required. FIG. 9 depicts the assembly of a combination window and door wall panel 64 possibly corresponding to an office located within the building. The panel 64 is assembled by attaching brick facing 66 to the sill panel and foundation 68 to form a sill wall 69 and brick facing 42 and spandrel panel 20 to door and window unit 72. Two such assemblies are required.

Figure 10:
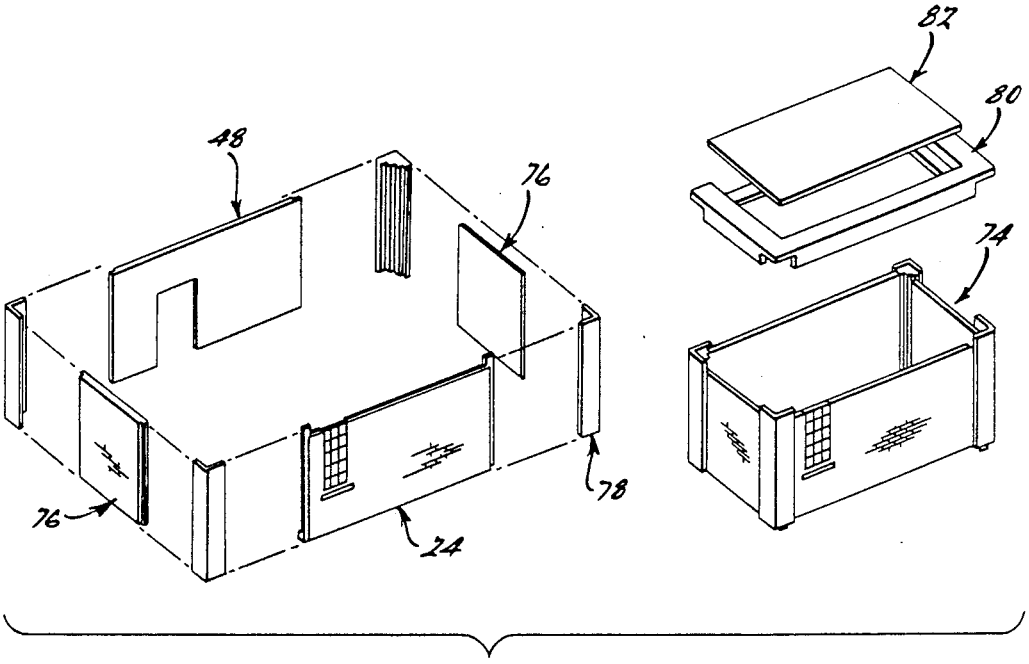
FIG. 10 is a perspective view and assembly of the penthouse.

FIG. 10 decipts the assembly of penthouse 74 by attaching wall panel 24 from FIG. 4 and the wall panel 48 from FIG. 7 with wall units 76 and outer corner columns 78. The roof unit 80 is attached to the top of penthouse 74 and penthouse roof panel 82 is inserted within panel 80.

Figure 11:
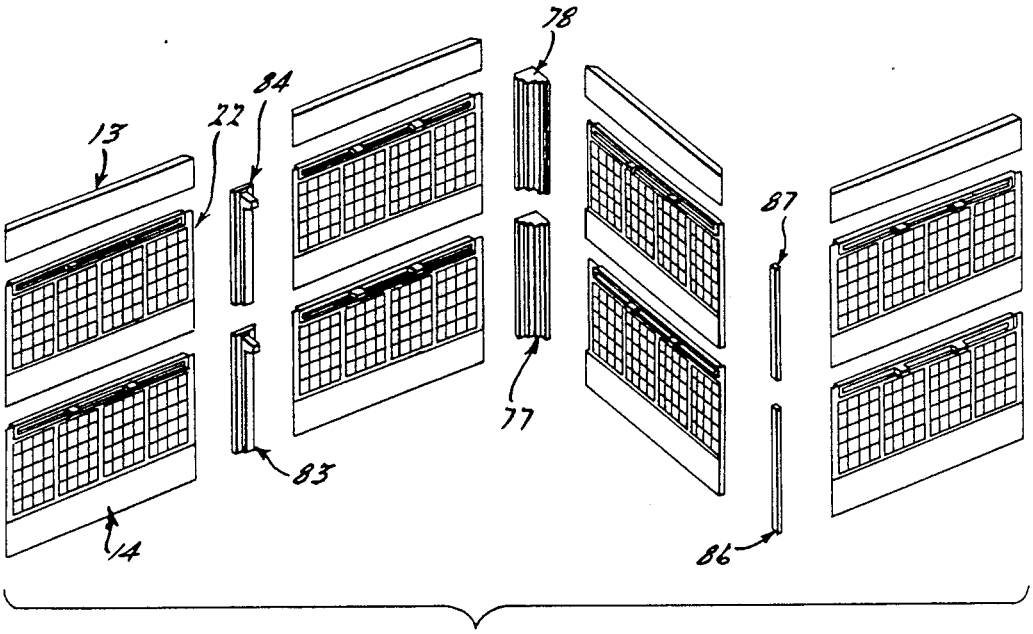
FIG. 11 is a perspective view and assembly of the wall panels, columns and parapet.

FIG. 11 is a view of the assembly of wall panels 14 and 22 from what will be the interior of the building. It should be noted that the panel 14 has a foundation 19 so that it can only be used on the first floor. The sill wall 11 assembly from FIG. 1 is used as the parapet 13 of the building, which is attached to the wall panel 22 and protrudes above the roof panel 88.

Figure 12:
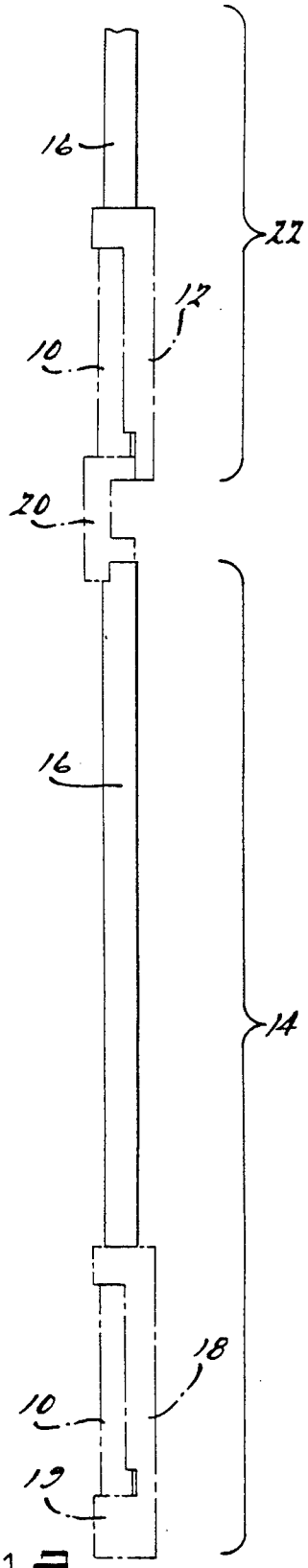
FIG. 12 is a side view of the interconnection of the wall panels.

FIG. 12 is an enlarged side view depicting the interconnection of wall panels 14 and 22. The wall panel 14 rests upon foundation 19 which is part of first floor sill panel 18 and brick facing 10 is shown attached to the outwardly facing portion of first floor sill panel 18. The window frame 16 is attached to the sill wall 18 and supports spandrel panel 20 to form wall panel 14. The sill panel 12 and brick facing 10, which forms the sill wall 11, is attached to the window frame 16 to form wall panel 22. The wall panel 22 is secured to the top of the wall panel 14 at the spandrel beam 20. It should be noted that since the sill panel 12 does not have a foundation, the brick facing 10 rests flush with spandrel beam 20 and sill panel 12 abuts the rear portion of spandrel beam 20. Because of the interconnection between am the sill wall 11 and spandrel beam 20, no seam is visible between brick facing 10 and the spandrel beam 20 from the exterior of the building. This assembly represents the interconnection of all first floor panels to upper floors panels, the upper floor wall panels to each other and the parapet 13 to the top floor wall panel.

Figure 14:
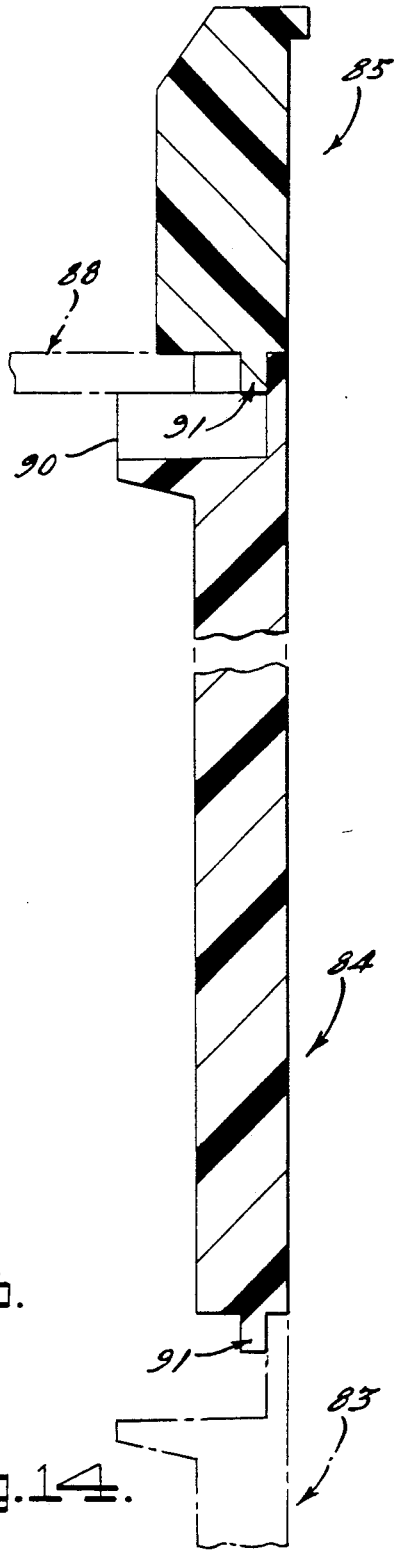
FIG. 14 is a sie view of the interconnection of columns, column cover and roof panel.
Figure 13:
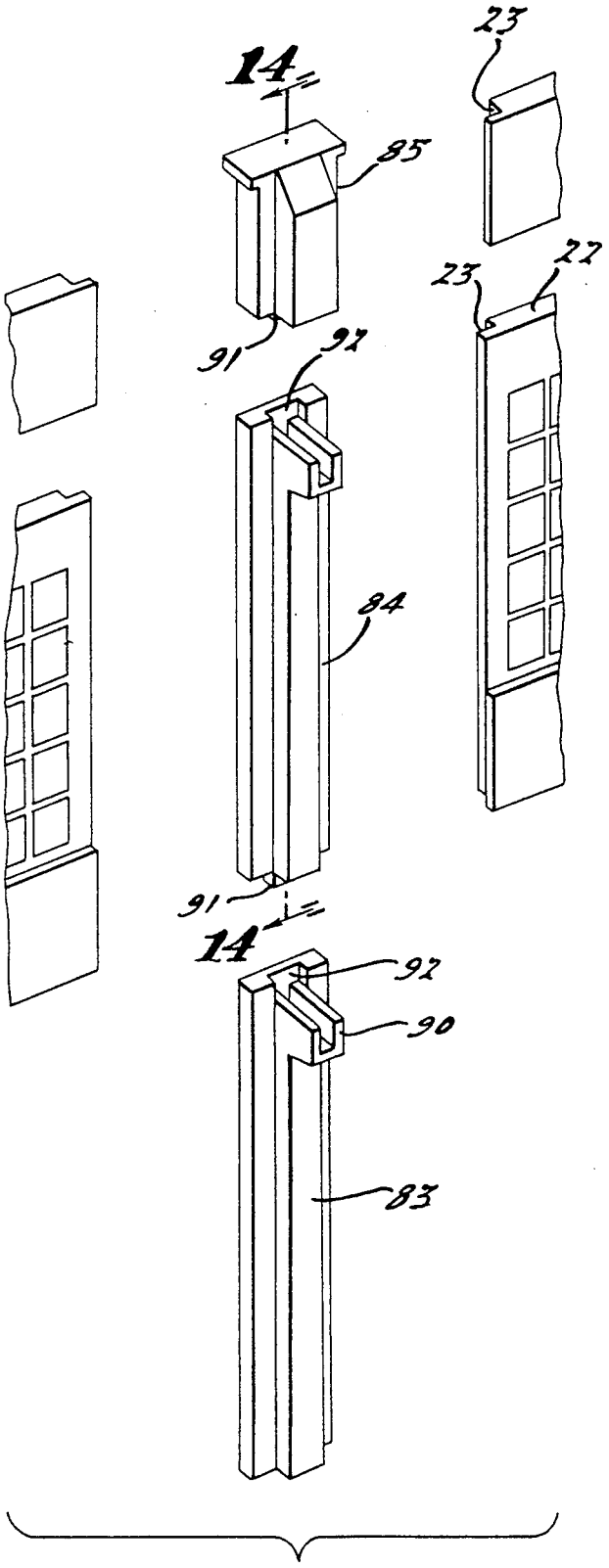
FIG. 13 is an enlarged perspective view and asembly of the columns and walls panels.

Referring again to FIG. 11, the wall panels 22 and 14 are supported vertically by straight wall columns 83 and 84, outer corner columns 77 and 78 and interior corner columns 86 and 87. FIG. 13 is an enlarged view of the assembly of the straight wall columns 83 and 84 and column cover 85 to wall panel 22 and parapet 13. The wall panel 22 has a notched portion 23 which runs along its vertical edge to accommodate the column 84 and parapet 13 has an identical notch portion 23 which engages column cover 85. It should be noted that while only wall panel 22 and parapet 13 are shown, all wall panels have notched portions 23 in their vertical sides which engage the columns and provide structural support. Column 84 has a tab portion 91 which corresponds to an opening 92 in the top of column 83. Column cover 85 has a similar tab 91 which corresponds to an opening 92 to the top of column 84. The tab portions 91 and openings 92 interconnect to furtgher support the columns. FIG. 14 is a side view taken along line 14 of columns 83, 84 and column cover 85. The side view depicts how tab 91 engages the opening 92 to interconnect the columns. The columns further have a U-shaped member 90 which supports the roof panel 88. The column cover 85 is further supported by the roof panel 88.

Figure 15:
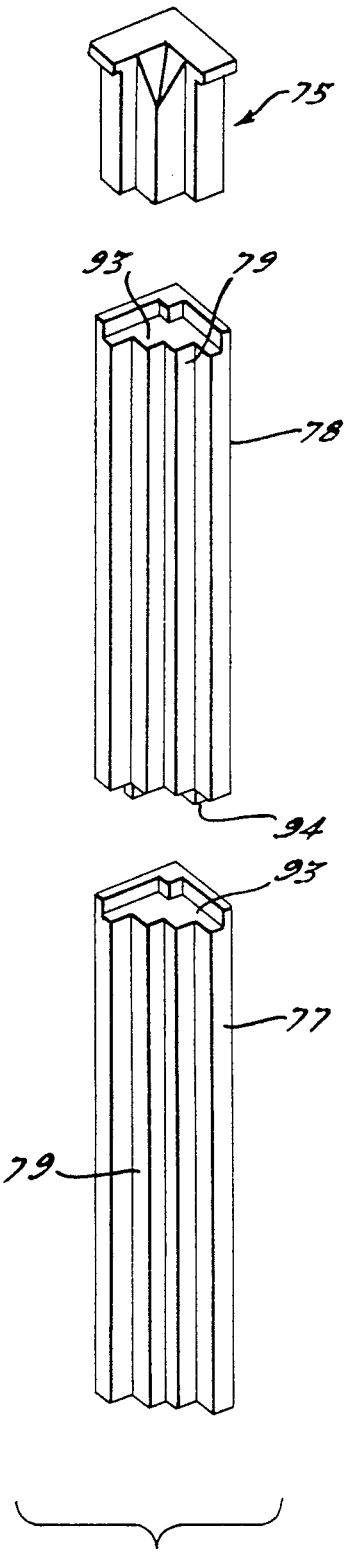
FIG. 15 is a perspective view and assembly of the outer corner columns and column cover.

FIG. 15 is an enlarged view of the outer corner columns 77 and 78, and corner column cover 75. The columns 77 and 78, and cover 75 have a sawtoothed edge 79 to engage the notched portions 23 in the wall panels. Also, column 78 and cover 75 have L-shaped tabs 94 which corresponds to an L-shaped notch 93 in columns 77 and 78 which interlock the columns together.

Figure 16:
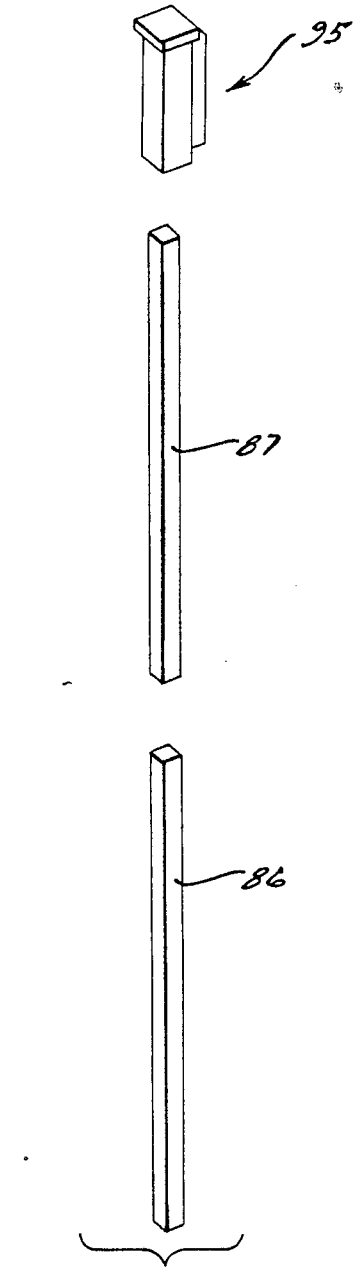
FIG. 16 is a perspective view and assembly of the inside corner columns and column cover.

FIG. 16 shows the assembly of interior columns 86 and 87 with column cover 96. The columns 86 and 87 have a square cross-sectional shape which corresponds to the notch portions 23 in the wall panels.

Figure 17:
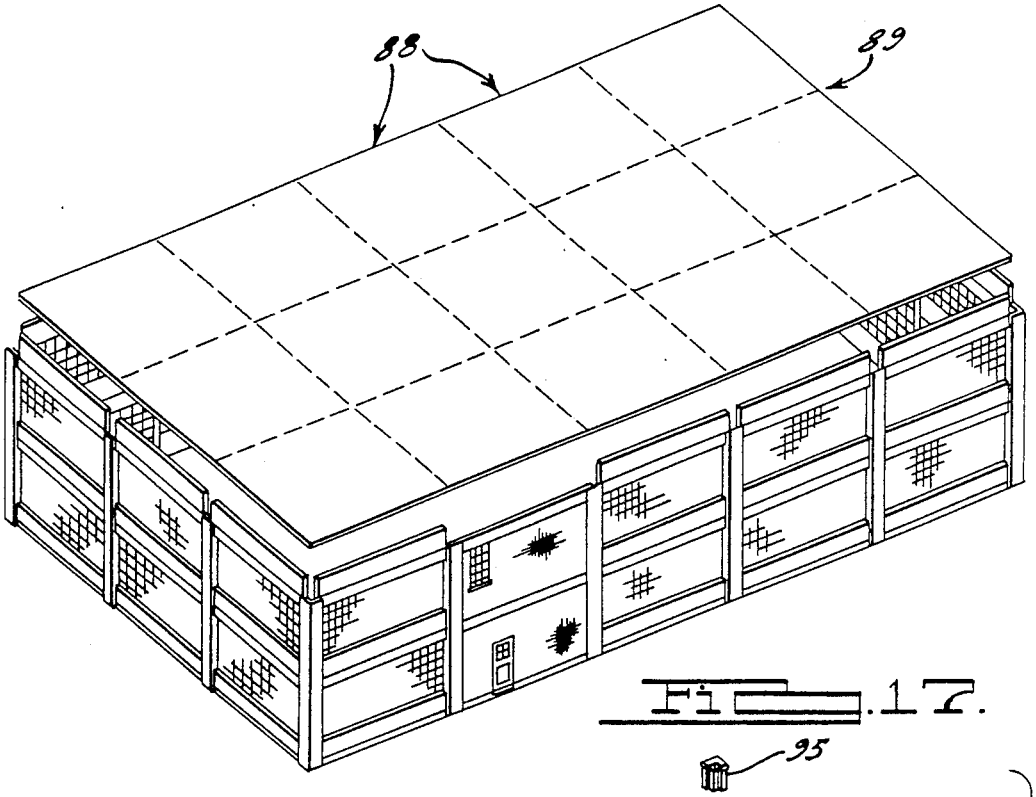
FIG. 17 is a perspective view of one embodiment of the building with the roof being assembled.

FIG. 17 is a view of one assembly of the building with the wall panels and parapet 13 in place with the roof panel 88 being attached. Roof panel 88 rests upon U-shaped member 90 and tabs 21 in spandrel beam 20. The panel is notched in a grid pattern 89 which corresponds to the length of each wall panel. The grid pattern allows the builder to cut the roof panel to conform to whatever shape building is desired.

Figure 18:
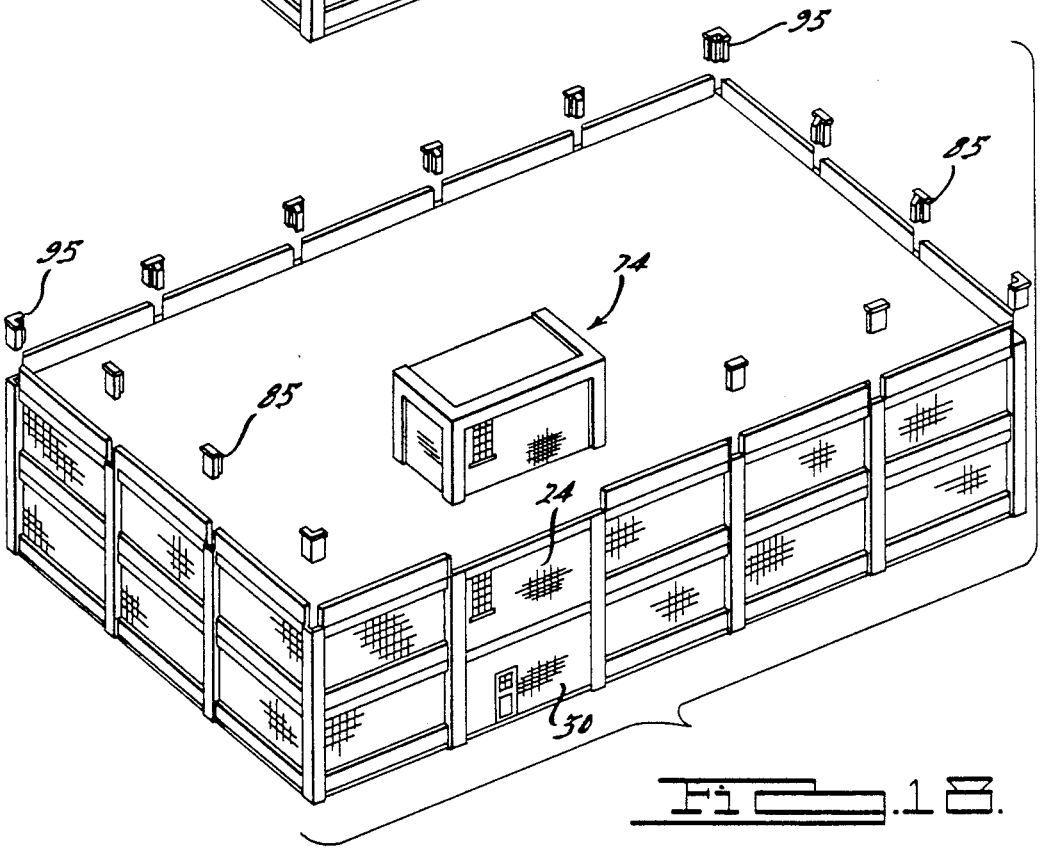
FIG. 18 is a perspective view of the building and assembly of column covers and the penthouse.
Figure 20:
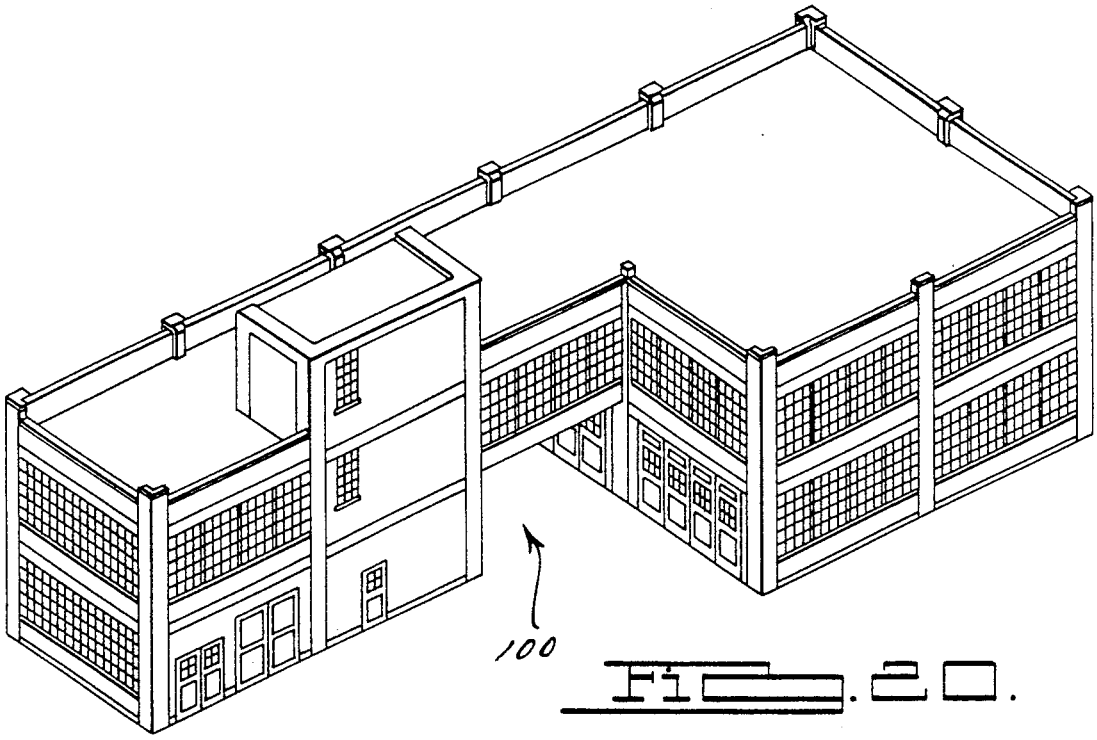
FIG. 20 is a perspective view of possible building design of the claimed invention.
Figure 19:
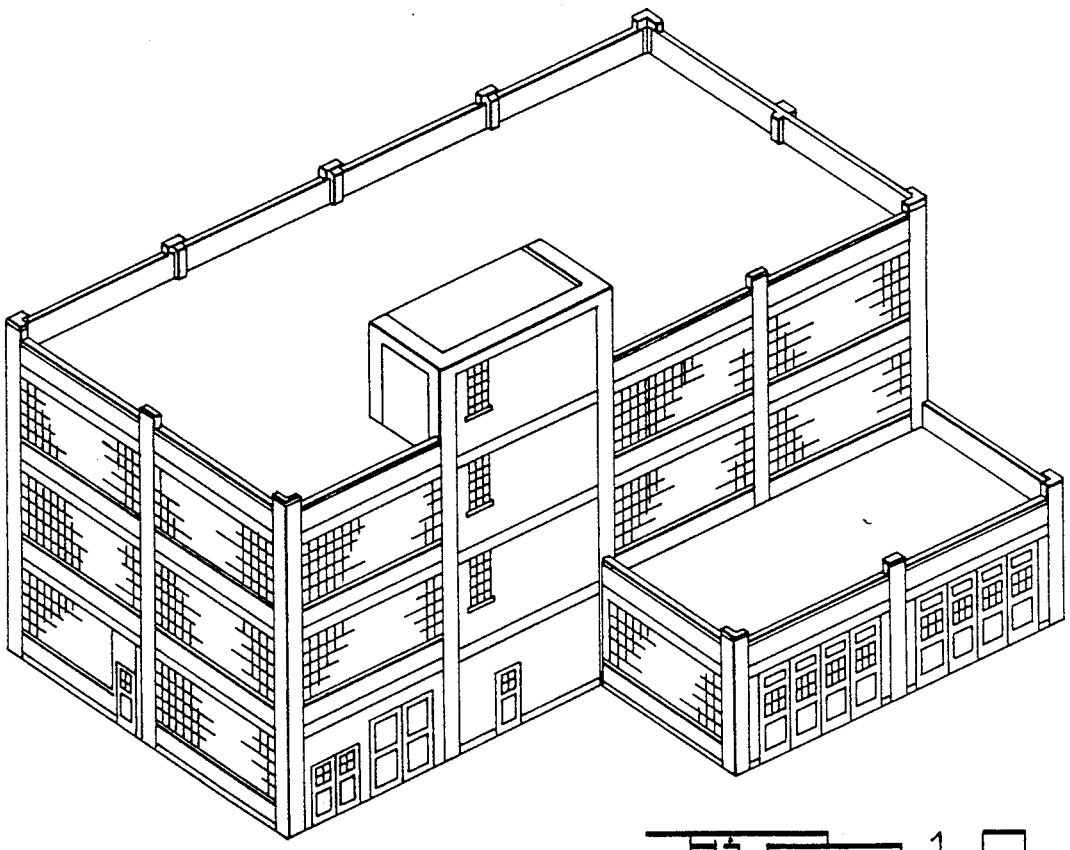
FIG. 19 is a perspective view of possible building design of the claimed invention.

FIG. 18 depicts the assembly of column covers 75 and 85 and penthouse 74. It is important to note that, to create an accurate reproduction, the penthouse 74 should be placed in alignment with wall panels 24 and 30 which will represent the location of the elevator shaft within the building. Further, no parapet is to be placed above wall panel 24 because penthouse 74 is to be attached in alignment with wall panel 24. FIGS. 19 and 20 show various assemblies that can be made from one typical kit. FIG. 19 shows a three-story building with a one-story lower entrance portion, generally designated 98. It should be noted that the roof panel 88 may be cut and separated to form a multiple story building. FIG. 20 depicts a building, generally designated 99, in which an underpass 100 has been designed in the building. In this design, the roof panel 88 has been cut into an L-shape, showing again the versatility of the claimed invention, and more particularly the roof panel 88. The roof panel 88 may also be used as the ceiling panel under the overhang. Moreover, building 99 has incorporated interior column 87 and column cover 95 at the interior corner 101 adjacent to the inderpass 100.

Thus, it is apparent there has been provided, in accordance with the invention a model building kit that satisfy the objects, aims and advantages set forth above. While this invention has been described in conjunction with the specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A model kit comprising interchangeable modular units which can be assembled to form a scale replica of an industrial building further comprising:

a plurality of distinct, architecturally significant, multi-piece, interchangeable first floor wall panels; a plurality of distinct, architecturally significant, multi-piece, interchangeable upper floor wall panels; a plurality of one piece modular roof panels; and a plurality of interchangeable outside corner, inside corner and intermediate columns, each being architecturally distinct and significant; wherein said interchangeable first floor and upper floor wall panels, columns and roof panels are assembleable to form multiple free standing building designs from said model building kit.

2. A model building kit comprising interchangeable modular units which can be assembled to form a scale replica of an industrial building, further comprising:

a plurality of distinct, architecturally significant, multi-piece, interchangeable wall panels; a plurality of one piece modular roof panels; and a plurality of interchangeable outside corner, inside corner and intermediate columns, each being architecturally distinct and significant; wherein said interchangeable wall panels, columns and roof panels are assembleable to form multiple free standing building designs from said model building kit.

3. A model building kit as defined in claim 1, wherein said plurality of roof panels is comprised of one-piece, modular roof panels with a square grid pattern notched in one surface of said panels, the length and width of said panels being multiples of said interchangeable wall panel unit length, and the distance between said grids corresponding to the unit length of said interchangeable wall panels to allow said panels to be accurately cut to fit a particular architectural design.

4. A model building kit as defined in claim 1, wherein each of said one piece, modular roof panels may be used in the interior of said free standing building as one piece floor panels.

5. A model building kit as defined in claim 1, wherein said wall panels are horizontally and vertically interconnectable providing a realistic appearance for said free standing model building.

6. A model building kit as defined in claim 1, wherein said wall panels are comprised of modular interchangeable sub-units that architecturally define and differentiate said panels, whereby providing multiple wall panel designs from said model building kit.

7. A model building kit as defined in claim 1, wherein said wall panel modular interchangeable sub-units may be assembled into architecturally and dimensionally distinct first floor wall panels and upper floor wall panels to provide architectural significance between the first floor wall panels and upper level wall panels.

8. A model building kit as defined in claim 7, wherein said first floor wall panels are the only structure to provide a foundation that supports the building.

9. A model building kit as defined in claim 6, wherein said modular sub-units are manufactured in color and with architecturally significant exterior surfaces so that no painting or texturing of said sub-units is required by a builder.

10. A model building kit as defined in claim 1, wherein said model building kit is assembled to form a complete, free standing, multi-story, architecturally significant model building.

11. A model building kit as defined in claim 1, wherein said model building kit is assembled to form a partially complete, free standing model building providing a architecturally significant, false facade.

12. A model building kit as defined in claim 1, wherein said wall panels have pre-notched side portions, wherein said columns may interchangeably connect to said wall panels.

13. A model building kit as defined in claim 1, wherein said inside corner, outside corner, and intermediate architecturally distinct columns are individually assembled to provide a free standing structural support and a realistic architecturally significant appearance for said model building.

14. A method of assembling a scale replica of an industrial building from a model building kit, and kit having modular units providing a variety of building designs from said kit, comprising the steps of:

(a) assembling said modular units to form interchangeable wall panels;

(b) repeating step (a) to achieve a desired number of wall panels to erect said building;

(c) interconnecting said wall panels along vertical edges of said panels with columns providing structural support for said model building;

(d) repeating step (c) to achieve a desired first floor building design;

(e) stacking wall panels on a plurality of first floor wall panels to provide upper floors for said model building;

(f) interconnecting a plurality of upper floor wall panels along a vertical edge of said columns, whereby a plurality of upper columns are stacked on a plurality of first floor columns providing structural support for the upper floor wall panels of said model building;

(g) repeating steps (e) and (f) to achieve a desired building design; and (h) attaching a roof panel to a plurality of wall panels and columns on the top floor of said building.

15. The method of claim 14 and additionally comprising after step (g) and before step (h) thereof, attaching a roof panel to the interior of said building providing floors within said building and to add detail therein.

16. The method of claim 14 and additionally comprising the step of assembling a penthouse and attaching said penthouse to said roof panel.

17. The method of claim 14 and additionally comprising the step of attaching column covers to upper portions of said top floor columns and parapet to upper portions of said top floor wall panels.

18. The method of claim 14, wherein the first floor wall panels include a foundation portion therein.

19. The method of claim 14, wherein said model building is a complete, multi-story model building.

* * * * *